United States Patent [19]

Yamada et al.

[11] Patent Number: 4,489,765

[45] Date of Patent: Dec. 25, 1984

[54] METHOD OF SUPPLYING A FINE-PARTICLE POWDER

[75] Inventors: Noboru Yamada; Keisuke Yamaguchi, both of Hachioji, Japan

[73] Assignee: Konishiroku Photo Industry Co., Ltd., Tokyo, Japan

[21] Appl. No.: 398,204

[22] Filed: Jul. 14, 1982

[30] Foreign Application Priority Data

Jul. 22, 1981 [JP] Japan ..... 56-115553

[51] Int. Cl.[3] ..... B65B 1/06

[52] U.S. Cl. ..... 141/1; 141/319; 141/375; 206/624

[58] Field of Search ..... 141/1, 284, 310, 319, 141/369, 383, 386, 375, 378, 379, 390, 391; 206/624

[56] References Cited

U.S. PATENT DOCUMENTS

| | | | |
|---|---|---|---|
| 2,653,744 | 9/1953 | Behr | 141/1 |
| 3,690,544 | 9/1972 | Meyers | 206/624 |
| 3,877,499 | 4/1975 | Fluster | 141/364 |
| 4,237,943 | 12/1980 | Ermel et al. | 141/364 |
| 4,304,273 | 12/1981 | Caudhill et al. | 141/364 |

*Primary Examiner*—Stephen Marcus
*Attorney, Agent, or Firm*—Frishauf, Holtz, Goodman and Woodward

[57] ABSTRACT

A method of supplying a fine-particle powder from a container to an apparatus through an opening therein, comprises causing an engagement portion formed in part of the container to cooperate with an engagement portion formed in the apparatus adjacent to the opening such that the fine-particle powder can spontaneously be moved while the container is maintained stationary. The method may further comprise causing an engagement portion formed in part of the outer machine frame of an electrostatic recording apparatus to engage with an engagement portion formed in part of a container therein, such that the fine-particle powder can be supplied to a hopper through an opening formed in the apparatus adjacent to the engagement portion thereof. The container can thus be positively held and fixed by the engagement of the container with the body of the apparatus, and the scattering and floating toner particles can be completely prevented from leaking out of the outside or inside of the machine.

13 Claims, 5 Drawing Figures

METHOD OF SUPPLYING A FINE-PARTICLE POWDER

BACKGROUND OF THE INVENTION

The present invention relates to a method of supplying a fine-particle powder from a container to another vessel or a hopper provided in an electrostatic printing apparatus or the like, and more particularly to a method in which by causing part of said container to engage with part of the apparatus, said container is maintained stationary such that a powder can spontaneously be supplied to said apparatus. For convenience in explanation, the following description will be given with reference to an electrophotographic copying apparatus.

In such an apparatus, it is well known that an electrostatic latent image formed on a photoreceptor is visualized in a development process. It is also well known that an amount of toner is suitably re-supplied to stabilize, in amount, the toner in the developer which may otherwise decrease as the development process is repeated. The description will be given in connection with a so-called two-component developer including ferromagnetic particles which are called "carrier", such as iron particles, and toner particles. It is to be understood, however, that the present invention can be applied to other similar apparatuses utilizing a magnetic one-component toner (one-component developer) in which the ferromagnetic particles unite with resinous particles (toner), and other powders. The objective powder used in apparatuses to which the present invention can be applied will now be referred to as "toner" representatively.

There have been proposed the following methods of supplying the toner:

(1) After a developing device has been removed from the body of an apparatus, the opening of a hopper mounted on the apparatus is engaged by the mouth of a toner container which will be in turn tilted to supply the toner therein to the hopper.

(2) A toner containing cartridge is slid to a hopper along rails in the body of the apparatus. After the cartridge has been positioned relative to the hopper, part of the cartridge is broken through any suitable means such as string or the like to supply the toner therein to the hopper.

(3) After removing a closure, an opened toner container is fixedly mounted on the toner receiving portion of a developing device by means of a threaded portion formed on the body of the container.

In such a position, the closure can be re-mounted on the container. The container is left intact in this position until the previously supplied toner in the developing device will have been consumed.

The first prior art method has a disadvantage in that the toner is scattered or floats in the air on supplying it because of very small specific gravity of the toner which is in the form of fine particles having particle diameters in the range of about 5~30 μm, resulting in contamination of the surrounding areas and the hands and garment of an operator.

The second prior art method is an improvement to the first method, but has also a disadvantage in that the operation is very cumbersome because the cartridge must manually be manipulated after it has been set in position.

The third prior art method is most convenient of the three prior art methods mentioned above. However, the toner container must always be mounted within the apparatus even if the re-supply of toner is not required. This means that an excess space is required, resulting in a large-sized machine.

SUMMARY OF THE INVENTION

It is an object of the present invention to overcome the above disadvantages in the prior art and to provide a method in which part of the apparatus is utilized to maintain a toner container stationary in a simple manner such that the supply of toner can spontaneously be effected without any manual operation.

Another object of the present invention is to provide a method for attaining the same purpose as aforementioned, in which an engagement portion formed in an electrostatic printing apparatus adjacent to an opening formed in part of the outside frame thereof is engaged by another engagement portion formed in part of a toner container to maintain the toner container stationary.

Namely, a method of the present invention of supplying a fine-particle powder from a container to an apparatus through an opening therein comprises causing an engagement portion formed in part of said container to co-operate with an engagement portion formed in said apparatus adjacent to said opening such that said fine-particle power can spontaneously be moved while said container is maintained stationary.

Further, a method of the present invention of supplying powder may comprise causing an engagement portion formed in part of the outer machine frame of an electrostatic printing apparatus to engage with an engagement portion formed in part of a container therein, such that said fine-particle powder can be supplied to a hopper through an opening formed in said apparatus adjacent to said engagement portion thereof.

BRIEF DESCRIPTION OF THE DRAWINGS

FIG. 3(*b*) is a schematic view showing the relationship between the toner container and a toner receiving bag;

DETAILED DESCRIPTION

Figure 1:
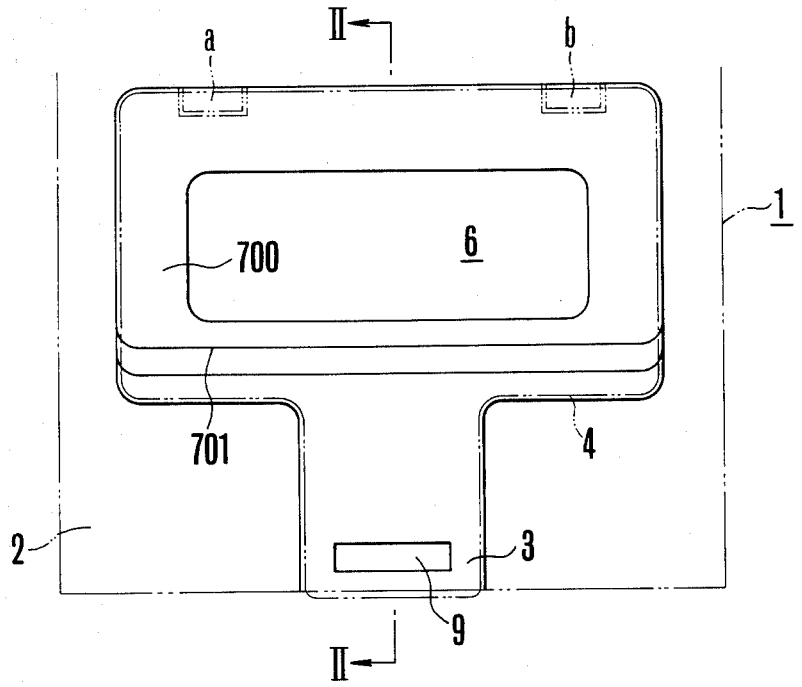
FIG. 1 is a schematic top view of a toner supply section in an apparatus which is one embodiment of the present invention.

The present invention will now be described with reference to the embodiments illustrated in the accompanying drawings. In the drawings, various components which do not relate directly to the present invention, such as a photoreceptor, optical systems, a document to be copied and processing means, are omitted.

Figure 2:
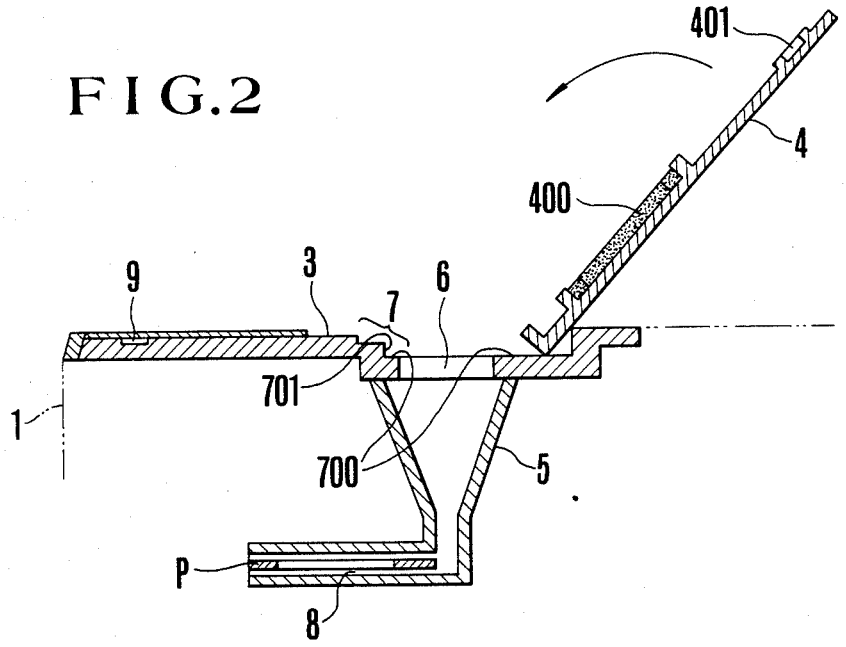
FIG. 2 is a cross-sectional view taken along a line II—II in FIG. 1, showing the positional relationship among various components such as the cover, hopper, etc.

FIG. 1 is a schematic top view of a supply section to the body of an apparatus, and FIG. 2 is a cross-sectional view taken along a line II—II in FIG. 1 wherein a cover 4 is shown to be opened. In FIGS. 1 and 2, reference numeral 1 designates the machine frame of an electrophotographic copying apparatus, 2 the top face thereof, and 3 a T-shaped recess formed in said top face at one end. The entire area of the recess is substantially covered by a cover 4 which is pivotably connected to the apparatus by means of two hinges a and b. The tip of the cover 4 somewhat extends outwardly from the one end of the apparatus. An opening 6 is formed in part of the recess 3 at a position corresponding to a hopper 5 which is mounted within the apparatus. As viewed in FIG. 2, the left-hand edge of the opening 6 has a stepped portion 7 formed therein. The number of steps in the stepped portion 7 can suitably be selected, for example, to be one or two. However, such a stepped portion may not necessarily be provided in the present invention providing a method in which part of the apparatus body co-operates with part of the toner container to simply hold the container stationary, thereby effecting the supply of toner therefrom without any manual operation. Therefore, if only the stepped portion is described with reference to FIG. 2 or 5, the left-hand edge of the opening 6 may merely include a flat surface 700 on which the toner container can be placed at one side edge. Alternatively, the flat surface 700 may be cut out to form a vertical wall 701 which can be used to engage the said wall of the toner container. Furthermore, a sloped surface may be similarly used in place of the vertical wall 701.

The other engagement portion for the toner container in the illustrated embodiment (more particularly, part of the cover 4) will be described hereinafter.

Reference numeral 8 denotes a toner feeding passage which is provided at the bottom of hopper 5 and includes an apertured feed plate P reciprocable in the passage for carrying the toner from the hopper to a suitable developing device. The feed plate 8 is of such dimensions that gaps are formed between the inner walls of the passage and the faces of the feed plate at least at its top and sides (perpendicular to the drawing) so as to smoothly move the feed plate between the inner walls of the passage 8.

As best shown in FIG. 2, an elastomeric body or sealing member 400 of, for example, polyurethan foam, is mounted on that portion of the cover 4 which will engage the perpheral margins of the opening 6 or contact with the flat surface 700. This sealing member serves to prevent the floating toner particles from leaking out of the hopper in the normal copying operation. In the illustrated embodiment, the sealing member 400 can be also utilized to be a member for engaging the toner container as will be described hereinafter. Reference numeral 401 designates a magnet located on the cover 4 adjacent to the outwardly extending end portion thereof. When the cover 4 is moved from its open position shown in FIG. 2 to its closed position, the magnet 401 engages a metal piece 9 disposed on the apparatus in position to lock the cover against the apparatus under the action of the magnetic field without any vibration. The placement of the above-mentioned magnet and the metal piece may be reversed.

Figure 3:
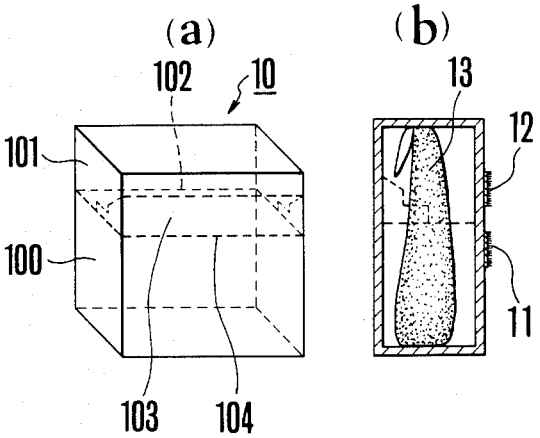
FIG. 3(*a*) is a schematic view showing the outline of a toner container.
Figure 4:
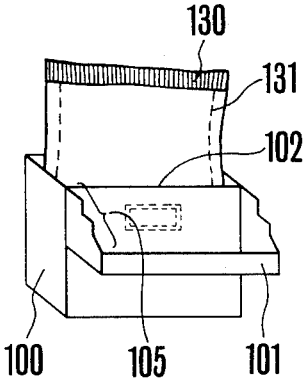
FIG. 4 is a view showing the toner container in such a state that the lid portion thereof is pivoted and the upper end of the toner receiving bag is cut off.

An example of the container which is one component required to accomplish the present invention will now be described with reference to FIGS. 3 and 4. Reference numeral 10 designates a box-like container as a whole which comprises a body portion 100 and a lid portion 101. As can be seen particularly from FIG. 4, the lid portion 101 is adapted to be pivoted about a fold portion 102 which is formed in one face of the container body (sometimes called "back face" or "rearward wall") at any suitable position. Actually, the fold portion is perforated to facilitate the movement of the lid portion. Reference numeral 103 denotes a tear-off portion which is formed on the front face (sometimes called "forward wall") of the box-like container. The tear-off portion includes one reference side 104 which is actually formed of a perforation and positioned at the same level as that of the fold portion 102 between the top and bottom of the container. The tear-off portion also includes the other reference side which is similarly formed of a perforation and spaced away from the first reference side 104 to prevent the other reference side of the tear-off portion from interfering with the top end of a toner receiving container 13 when the lid portion 101 is pivoted. The toner receiving container 13 will be described hereinafter and called "toner receiving bag" for avoiding confusion with the toner container 10. Further, the side walls of the container 10 and lid 101 are perforated to form stepped portions 105 therein when the tear-off portion 103 is removed. Reference numerals 11 and 12 denote fasteners provided on the body portion 100 of the container and the lid portion 101. When the lid portion is pivoted and shifted to its open position as shown in FIG. 4, these fasteners 11 and 12 engage with each other to hold the container body and lid portions in such an open condition. The fasteners used actually comprise two small pieces 11 and 12 with one of these pieces comprising of a fabric substrate and a plurality of loop-shaped fiber elements disposed thereon. The other small piece is comprised of a similar fabric substrate and a plurality of top-hooked fiber elements located thereon which are adapted to engage the loop-shaped fiber elements when the two small pieces are pressed against each other.

Figure 5:
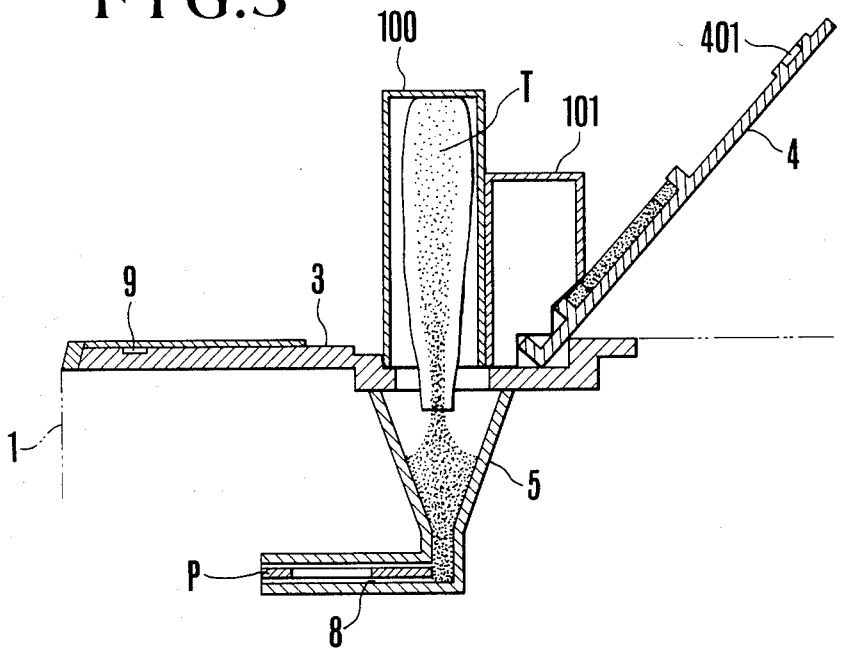
FIG. 5 is a view showing the toner container in such a state that it is placed on the apparatus of FIG. 2.

Other fastener means may be of course used in the present invention. If one can withstand some inconvenience when the toner receiving bag 13 in the container 10 is cut off by means of scissors or the like as will be described hereinafter, the provision of fasteners is not particularly required because the elasticity of the container at the fold portion 102 can conveniently be utilized when the container 10 is placed on the apparatus in position. The toner receiving bag 13 is located within the container 10 with the bottom thereof bonded to the bottom and inner face of the container and contains the toner T therein. The toner includes hydrohobic silica as one component. When the toner is exposed to air (atmosphere), its flowability is very promoted. The toner particles tend to scatter in air if it is wrongly handled. Where the apparatus has a toner re-supply mechanism of such a construction that includes a hopper and a toner passage 8 of reduced length as shown in FIGS. 2 and 5, the toner particles tend to flow out of the passage through the left-hand end thereof on supplying the toner to the hopper. After an amount of toner is poured into the toner receiving bag 13 and before the open end of this bag is heat-sealed, air is excluded from the bag as far as possible. Reference numeral 130 (FIG. 4) designates the heat-sealed end portion. Reference numeral 131 denotes so-called "fourchette" portions forming side flaps in the toner receiving bag. The fourchette portions serve to gradually exhaust the toner even if it has its good flowability and ultimately to prevent the scattering or floating of toner particles as far as possible. The apparatus body and container thus constructed will be described with reference to the engaging and supplying processes thereof in order.

For example, in a copying apparatus of such a type that includes a movable document platen (not shown) initially positioned above the cover 4 on the top face 2 of the machine frame 1, the platen is first moved to expose the cover area in any suitable manner. Thereafter, the cover 4 is pivoted about the hinges a and b to the position shown in FIG. 2 against the magnetic attractive force between the magnet 401 and metal piece 9 by exterting an upward force on the portion of the cover 4 which extends somewhat outwardly from the machine frame. In this pivoted position, the cover 4 is held with an angle by co-operation of said hinges with part of the machine frame as shown in FIG. 2. Thus, the toner supply opening 6 and therefore the upper opening of the hopper 5 are exposed.

The tear-off portion 103 is removed from a new container 10 and the lid portion 101 is pivoted about the fold portion 102. The lid and body portions 101, 100 of the container engage with each other at their back faces and are held at this engaged state by means of the fasteners 11 and 12 which engage with each other when these portions 101 and 100 are brought into contact with each other. At this time, the upper, for example end of the toner receiving bag 13 is exposed and cut off by scissors to remove the heat-seal portion 130 from the bag. The thus opened upper end of the bag is held to provide less opening under the action of the fourchette portion 131 as described hereinbefore. The side of the container body 10 opposite to the opened lid portion 101 is then brought into engagement with the flat surface 700 gradually so as not to cause a relatively large amount of the toner to flow out of the toner receiving bag 10. Ultimately, the container will be positioned in its upright position in which the stepped portion of the lid portion 101 is engaged by the sealing member (polyurethane foam) 400 mounted on the inner face of the cover 4. In such a manner, the toner container 10 will be maintained stationary by means of the cover 4, vertical wall 701 and flat surface 700. Till this time, the toner gradually falls into the opening 6 spontaneously under the action of gravity. Any scattering and/or floating toner particles are prevented from leaking out of the machine by the container body and lid portions which engage the machine body and cover. The amount of scattering and/or floating toner particles is reduced also by the opening of the toner receiving bag 13 which is held at its less opened state under the action of the fourchette portions. After a suitable period of time, the container 10 is removed from the apparatus and then the cover 4 is closed to be ready for copying operation.

Thus, the toner supply method according to the present invention is very simple since the supply of toner can easily be effected without any manual operation by merely positioning the toner container on the apparatus body in position. Therefore, the operator will not feel apprehension about contamination of his hands and garment.

The toner container 10 can positively be held and fixed by the engagement of the container with the body of the apparatus.

The scattering and/or floating toner particles which may be produced on supplying the toner from the placed container can be completely prevented from leaking out of the outside or inside of the machine since a sealing state is provided between the container and the apparatus. In the preferred embodiment, the container 10 is made of a thick paper sheet such as cardboard. The toner receiving bag is of a double-layer construction made of polyamide sheet material and polyethylene sheet material which are bonded to each other, in consideration of changes in circumstances, shelf stability and others. However, the toner container and bag may be made of any other suitable material. The toner container may be of such a structure that the lid portion 101 is completely cut off from the container body. In such a case, the container may not positively be placed on the apparatus in such a position as shown in the drawings. Accordingly, it may be required to use other suitable means for supporting the container on the apparatus in place of the lid portion. Of course, the just now mentioned structure does not require such fasteners as aforementioned. Although various engagement surfaces as 700 are provided on the container placing area of the apparatus for holding the container at its upright position in the illustrated embodiment, a sloped toner supply passage may be provided between the opening of the hopper 5 and the opening 6 of the machine frame by the use of any suitable sealing material to fix the container which the lid or top thereof is removed into such a sloped passage so that the container can be maintained stationary by engagement of the container with the apparatus. Where a toner supply opening is formed in the side face of the apparatus body rather than the top face thereof or where there is a sufficient space within the apparatus, the toner supply mechanism for carrying out the method of the present invention may be of course provided within the apparatus. Although the cover 4 is utilized to carry out the method of the present invention in the illustrated embodiment, the cover may not necessarily be used if the object of the present invention can be accomplished without the cover.

We claim:

1. A method of supplying a fine-particle toner powder from a container having substantially rigid walls to a photocopying apparatus through an opening in the photocopying apparatus, said container having an engagement portion formed in a substantially rigid wall portion thereof, the photocopying apparatus having an openable door covering said opening of said photocopying apparatus and an engagement portion adjacent to said opening, and said container being separate from said photocopying apparatus, the method comprising:

opening said openable door of said photocopying apparatus;

opening a portion of said container while said container is separated from said photocopying apparatus to expose the fine-particle toner powder in said container;

placing said opened container in an upright position on said photocopying apparatus over said opened opening of said photocopying apparatus so that said container is supported by said photocopying apparatus, said opened portion of said container being at the bottom and in registration with said opening of said photocopying apparatus so that said fine-particle toner powder can fall spontaneously out through the opening of said container and through said opening of said photocopying apparatus;

said openable door of said photocopying apparatus including means defining said engagement portion of said photocopying apparatus; and causing said engagement portion formed in a substantially rigid wall portion of said container to cooperatively engage with said engagement portion on said openable door of said photocopying apparatus for positively maintaining said container in a substantially stationary position supported on said photocopying apparatus by said cooperative engagement while substantially all of said fine-particle toner powder is spontaneously falling from said container into said photocopying apparatus;

thereby substantially preventing scattering and floating out of toner powder particles from said container and from said photocopying apparatus during said spontaneous falling of said fine-particle toner powder.

2. The method of claim 1, wherein said container has substantially rigid side walls, and wherein said engagement portion of said container comprises a stepped portion formed in at least one of said substantially rigid side walls, and wherein said step of causing engagement includes engaging said stepped portion of said container with said engagement portion on said openable door of said photocopying apparatus.

3. The method of claim 2, wherein said container has a body portion and a lid portion which is foldable relative to said body portion to open said body portion, said stepped portion being formed in at least one of said body and lid portions.

4. The method of claim 3, wherein said stepped portion is formed in said lid portion and wherein said opening step comprises folding said lid relative to said body portion to a position adjacent said body portion.

5. The method of claim 4, further comprising adhering said lid to said body portion when said lid portion is folded to said position adjacent said body portion.

6. The method of claim 5, further comprising adhering said lid to said body portion when said lid portion is folded to said position adjacent said body portion.

7. The method of claim 3, wherein said container further comprises a flexible bag-like member internal of said rigid walls, said fine-particle toner powder being contained within said bag-like member, at least a portion of said bag-like member being adhered to an internal surface of said rigid walls of said container, and wherein said opening step comprises opening a rigid wall portion of said container and then opening a portion of said bag-like member to expose said fine-particle toner powder.

8. The method of claim 7, wherein said flexible bag-like member extends outwardly of said rigid wall portion of said container after opening of said rigid wall portion, and wherein said step of placing said open container on said photocopying apparatus comprises first placing said portion of said bag-like member which extends outwardly of said rigid wall portion of said container into registration with said opening of said photocopying apparatus, and then placing said rigid wall portion of said container on said photocopying apparatus so as to be supported by said photocopying apparatus.

9. The method of claim 4, further comprising a resilient seal member on said openable door in the vicinity of said engagement portion defined on said openable door for sealing against said stepped portion formed in said lid portion of said container when said stepped portion of said lid portion is engaged with said engagement portion of said openable door, thereby enhancing prevention of said scattering and floating out of toner powder particles.

10. The method of claim 1, further comprising providing a seal member on said openable door in the vicinity of said engagement portion defined on said openable door for sealing against said engagement portion of said container when said engagement portion of said container is engaged with said engagement portion of said openable door.

11. A method of supplying a fine-particle toner powder from a box-like container having substantially rigid walls to a photocopying apparatus through an opening in the photocopying apparatus; the photocopying apparatus having an engagement portion adjacent to said opening and said container being separate from said photocopying apparatus; said container having a body portion having a substantially rigid wall portion, a lid portion having a substantially rigid wall portion and which is hingedly connected to said body portion, and a removable tear-off portion coupled between said body and lid portions by perforations, whereby when said removable tear-off portion is removed from said container at said perforations, said lid portion is movable about said hinge connection to an open position to thereby open said container; the method comprising:

opening a portion of said container by tearing off said removable tear-off portion of said perforations and pivoting said lid portion about said hinge connection while said container is separated from said photocopying apparatus to expose the fine-particle toner powder in said container;

said perforations forming a stepped engagement in a substantially rigid wall portion of said lid portion when said tear-off portion is removed from said container;

placing said opened container in an upright position on said photocopying apparatus so that said container is supported by said photocopying apparatus, said opened portion of said container being at the bottom and in registration with said opening of said photocopying apparatus so that said fine-particle toner powder can fall spontaneously out through the opening of said container and through said opening of said photocopying apparatus; and causing said stepped engagement portion of said lid portion of said container to cooperatively engage with said engagement portion of said photocopying apparatus for positively maintaining said container in a substantially stationary position supported on said photocopying apparatus by said cooperative engagement while substantially all of said fine-particle toner powder is spontaneously falling from said container into said photocopying apparatus;

thereby substantially preventing scattering and floating out of toner powder particles from said container and from said photocopying apparatus during said spontaneous falling of said fine-particle toner powder.

12. The method of claim 11, wherein said hinge connection between said lid and body portions of said container comprises a fold portion which is formed in one face of said container body, said lid portion being adapted to be pivoted about said fold portion when said tear-off portion is removed to thereby open said container.

13. The method of claim 11, further comprising providing a seal between at least a portion of said container and said opening of said photocopying apparatus to improve prevention of said scattering and floating out of said toner powder particles.

* * * * *